US005514012A

United States Patent [19]

Natsume

[11] Patent Number: 5,514,012

[45] Date of Patent: May 7, 1996

[54] TRIM ARRANGEMENT FOR OUTBOARD MOTOR

[75] Inventor: Noriyuki Natsume, Hamamatsu, Japan

[73] Assignee: Sanshin Kogyo Kabushiki Kaisha, Hamamatsu, Japan

[21] Appl. No.: 302,206

[22] Filed: Sep. 8, 1994

[30] Foreign Application Priority Data

Sep. 8, 1993 [JP] Japan ..... 5-246089

[51] Int. Cl.[6] ..... B63H 5/12

[52] U.S. Cl. ..... 440/53; 440/61; 440/900

[58] Field of Search ..... 440/900, 53, 61; 248/640–642

[56] References Cited

U.S. PATENT DOCUMENTS

| | | | |
|---|---|---|---|
| 2,079,871 | 5/1937 | Price | 440/53 |
| 2,100,559 | 11/1937 | Irgens | 440/53 |
| 2,549,479 | 4/1951 | Kiekhaefer | 440/53 |
| 3,274,849 | 9/1966 | Hanson | 440/53 |
| 4,682,961 | 7/1987 | Nakahama | 440/61 |
| 4,813,896 | 3/1989 | Koike et al. | 440/61 |
| 4,986,773 | 1/1991 | Binversie et al. | 440/61 |

*Primary Examiner*—Edwin L. Swinehart

*Attorney, Agent, or Firm*—Knobbe, Martens, Olson & Bear

[57] ABSTRACT

A trim pin arrangement for an outboard motor wherein the trim pin apertures are disposed so as to extend substantially in a straight line to make the bracket more compact and also so that the trim pin will engage the swivel bracket at a different location depending upon which aperture it is received in so as to make more uniform the wear on the swivel bracket.

11 Claims, 5 Drawing Sheets

TRIM ARRANGEMENT FOR OUTBOARD MOTOR

BACKGROUND OF THE INVENTION

This invention relates to a trim arrangement for an outboard motor and more particularly to an improved trim pin arrangement for such applications.

As is well known, outboard motors are normally mounted on the transom of an associated watercraft by means of a clamping bracket that is connected in some manner to the transom. A swivel bracket is pivotally connected to the clamping bracket and mounts the propulsion device. The pivotal movement permits a trim adjustment of the propulsion device. The propulsion device is, in turn, supported by the swivel bracket for steering movement about a generally vertically extending steering axis.

It is the normal practice to employ in the clamping bracket a series of spaced-apart apertures that are adapted to receive a trim pin. This trim pin is abuttingly engaged by the swivel bracket and sets the trim condition of the propulsion device, depending upon which of the pair of apertures it is received in.

There are some disadvantages with this type of construction, which may be best understood by reference to FIGS. 1, 2, and 3, which depict three different types of prior art trim adjustment mechanisms. In each of these figures, a clamping bracket is indicated generally by the reference numeral 11 and the tilt pivot pin is identified by the reference numeral 12. Although the swivel bracket is not shown, it is to be understood that it is pivotally mounted on the tilt pivot 12 in a well-known manner. In order to permit trim adjustment, a series of apertures 13 are formed in the clamping bracket 11, and particularly outstanding leg portions thereof, to receive a trim pin, which is engaged by the swivel bracket in the manner aforedescribed so as to adjust the trim condition. This extending portion of the clamping bracket is identified by the reference numeral 14 in FIGS. 1–3, and it will be seen that the three figures illustrate three different types of arrangements along which the trim apertures 13 may be formed.

Referring first to FIG. 1, the apertures 13 are disposed so that their centers lie along an arc, indicated by the reference numeral 15, which arc is drawn at a radius R1 which passes through the center of each aperture and which has at its center the center or pivot axis defined by the tilt pivot pin 12.

FIG. 2 shows another arrangement, and this differs from the arrangement of FIG. 1 only in that the trim apertures 13 and the extending portion 14 are disposed lower on the clamping bracket 11. Hence, the arc 15 upon which the center of the apertures 13 lies is at a greater radius R2 than the radius R1 of FIG. 1.

In the third type of embodiment, there are provided pairs of apertures 13 which are disposed in the projection 14 at two different radii, one, R3 on an arc indicated by the line 16, and the other having a radius R4 lying on the arc 17. The radius R3 passes through the lowermost aperture 13 and through the centers of all of the other apertures on the arc 16. In a similar manner, the radius R4 passes through the center of the lowermost aperture on the arc 17, and all other apertures of this series lie on the same radius.

The prior art constructions as thus far described have two disadvantages. As may be seen from the figures, the projections 14 extend rather substantially rearwardly from the sides of the clamping bracket 11. As a result, they will be contacted by the drive shaft housing of the outboard motor, in a manner which will be described later by reference to the preferred embodiments of the invention, and limit the total degree of steering possible. In addition, the arrangements are such that the trim pin that is received in the apertures 13 will contact either the same or substantially the same area on the swivel bracket regardless of the trim adjustment. This is an area which is subject to wear, and accordingly, the prior art constructions have the effect that the trim axis will change as the swivel bracket becomes worn, and this wear is accelerated due to the contact always at substantially the same place.

It is, therefore, a principal object of this invention to provide an improved trim adjustment arrangement for an outboard motor.

It is a further object of this invention to provide an improved trim arrangement for an outboard motor that is compact in nature without sacrificing the range of adjustment and without interfering with the range of steering movement of the outboard motor.

It is a still further object of this invention to provide an improved trim arrangement for an outboard motor wherein the point of wear is shifted when the trim position is shifted so as to minimize the amount of localized wear that will occur on the outboard motor in the trim adjustment area.

SUMMARY OF THE INVENTION

The features of this invention are adapted to be embodied in an outboard motor that is comprised of a clamp bracket that is adapted to be affixed to a transom of an associated watercraft and a swivel bracket that is connected to the clamp bracket for pivotal movement about a trim axis. The swivel bracket carries a propulsion device for propelling an associated watercraft. The clamp bracket is formed with a series of apertures for receiving a trim pin that is operatively engaged by the swivel bracket for adjusting the trim position of the propulsion device.

In accordance with a first feature of the invention, the apertures are vertically arranged, with the uppermost aperture being positioned forwardly of an arc drawn about the trim axis and of a radius passing through the lowermost aperture.

In accordance with another feature of the invention, the apertures are arranged so that a trim pin contained in them will contact a different position on the swivel bracket for each trim aperture so as to spread the wear on the swivel bracket over a greater area than if the same point is engaged regardless of which aperture the trim pin is positioned in.

DETAILED DESCRIPTION OF THE PREFERRED EMBODIMENT OF THE INVENTION

Figure 4:
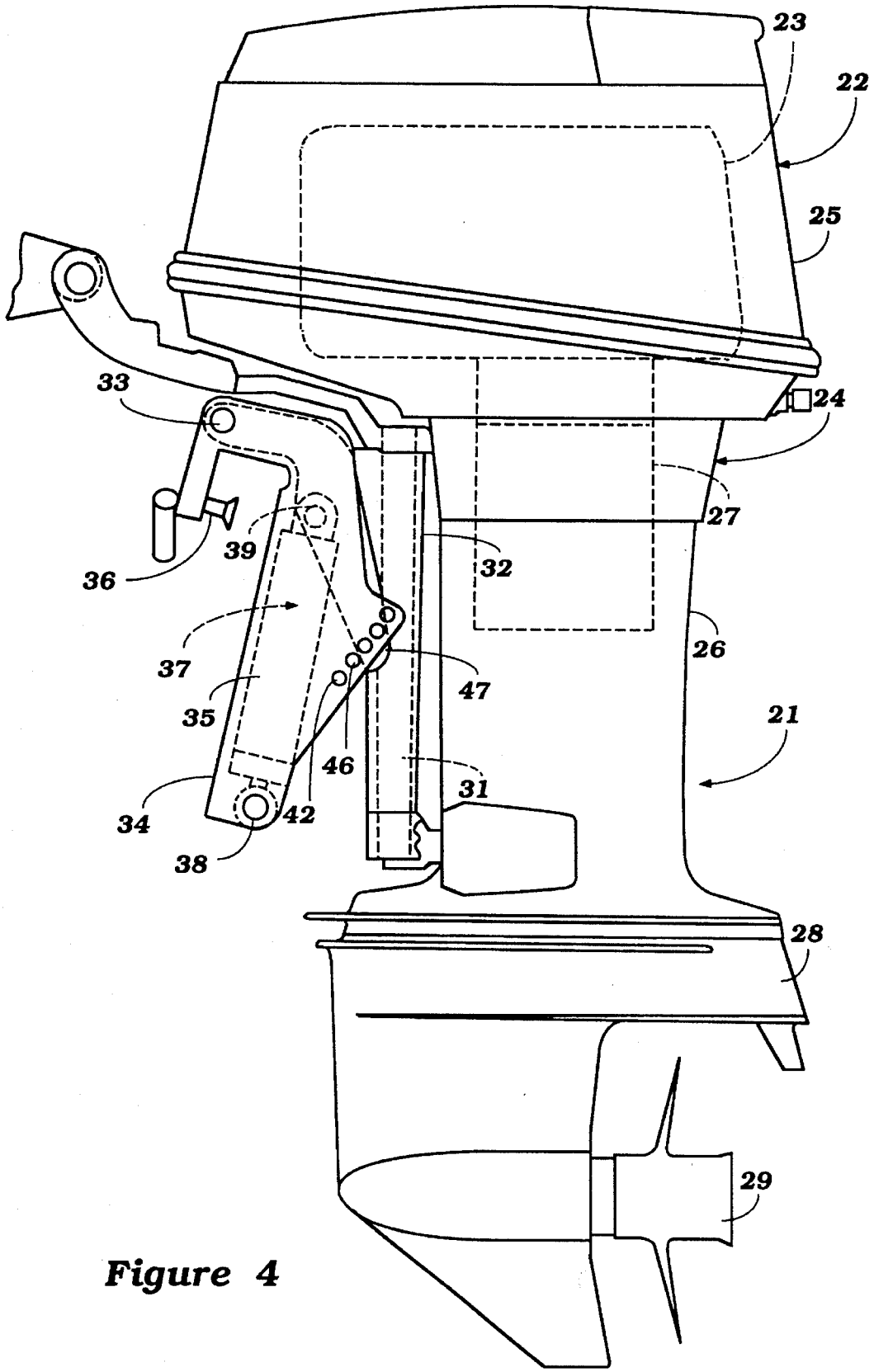
FIG. 4 is a side elevational view of an outboard motor constructed in accordance with an embodiment of the invention.

Referring now in detail to the drawings and initially primarily to FIG. 4, an outboard motor constructed in accordance with an embodiment of the invention is identified generally by the reference numeral 21. The invention is described in conjunction with an outboard motor because it has particular application in such an arrangement. However, it will be readily apparent to those people skilled in this art that the invention may also be utilized in conjunction with the outboard drive portion of an inboard/outboard drive. Hence, the term "outboard motor" is intended to be utilized broadly as including either type of outboard propulsion unit for a watercraft wherein it is desirable to trim the position of the propulsion unit relative to the watercraft.

The outboard motor 21 includes a power head, indicated generally by the reference numeral 22, which is powered by an internal combustion engine, indicated generally by the reference numeral 23 and which may be of any known type. This engine 23 is encircled by a protective cowling comprised of a lower tray portion 22 and an upper main portion 23 that is connected to the tray portion in a suitable manner.

As is typical with outboard motor practice, the engine 23 is supported so that its output or crankshaft rotates about a vertically extending axis and is coupled to a drive shaft (not shown) that depends into a drive shaft housing 26 which depends from the power head. The drive shaft housing 26 and which has its upper portion at least partially encircled by the tray 24. The engine 23 is, in the illustrated embodiment, operated on a four-stroke principle, and therefore, an oil reservoir 27 for the engine 23 depends into the upper end of the drive shaft housing 26.

The drive shaft aforereferred to extends beyond the lower end of the drive shaft housing 26 and terminates in a lower unit 28. The lower unit 28 contains a forward/neutral/reverse transmission (not shown) which is driven by the drive shaft for operating a propulsion device in the form of a propeller 29.

A steering shaft 31 is affixed in a known manner to the drive shaft housing 26 and is journaled for steering movement within a swivel bracket 32 of the type generally described in conjunction with the description of the prior art. This swivel bracket 32 is, in turn, connected by means of a tilt pivot pin 33 to a clamping bracket, indicated generally by the reference numeral 34. The tilt pivot pin 33 permits tilt and trim pivotal movement of the outboard motor 21, as aforedescribed.

The clamping bracket 34 has a pair of spaced-apart side portions 35 and a clamping device 36 for affixing it to the transom of an associated watercraft in a well-known manner.

Positioned between the side portions 35 is a hydraulic cylinder assembly 37 which may be provided with both a shock absorber and a fluid motor for effecting power tilt and trim operation, if desired. The hydraulic unit 37 has a pivotal connection at 38 to the clamping bracket 34 and a pivotal connection 39 to the swivel bracket 32, as is well known in this art.

The construction of the outboard motor as thus far described may be considered to be conventional, and for that reason, where any descriptions of the components of the outboard motor have not been described, they may also be considered to be of any type known in the art.

As should already be apparent, the invention deals with the trim pin arrangement for limiting the downward or trim-adjusted position of the outboard motor 21, and this construction will now be described by reference to the remaining figures, in addition to FIG. 4. Like the prior art constructions, the side plates 35 of the clamping bracket 34 have an outwardly extending portion 41, but it will be apparent that this portion 41 does not extend as far rearwardly as with the prior art type of constructions for a reason which will become apparent.

Figure 3:
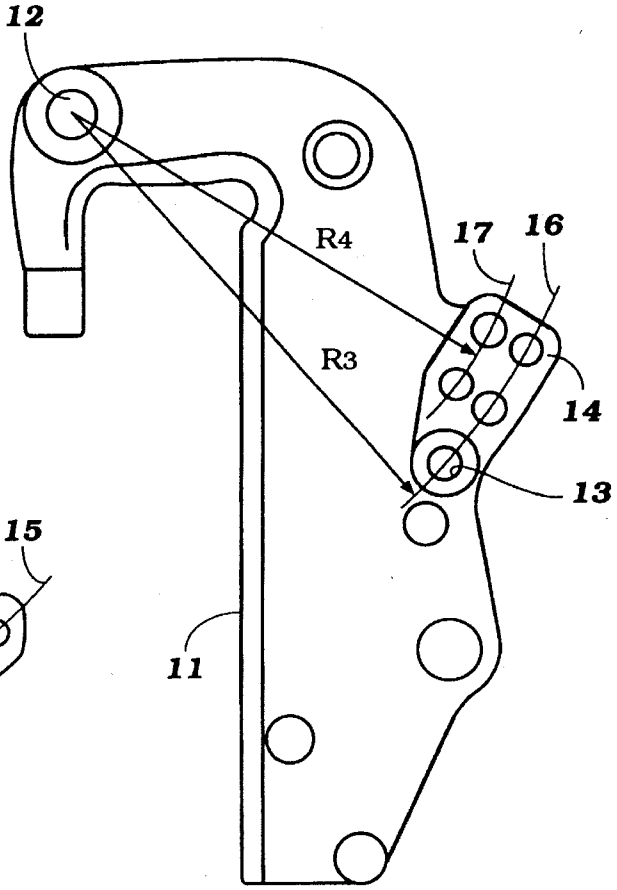
Figure 3 Prior Art
FIGS. 1, 2, and 3 are side elevational views of three different forms of prior art clamp bracket constructions.
Figure 2:
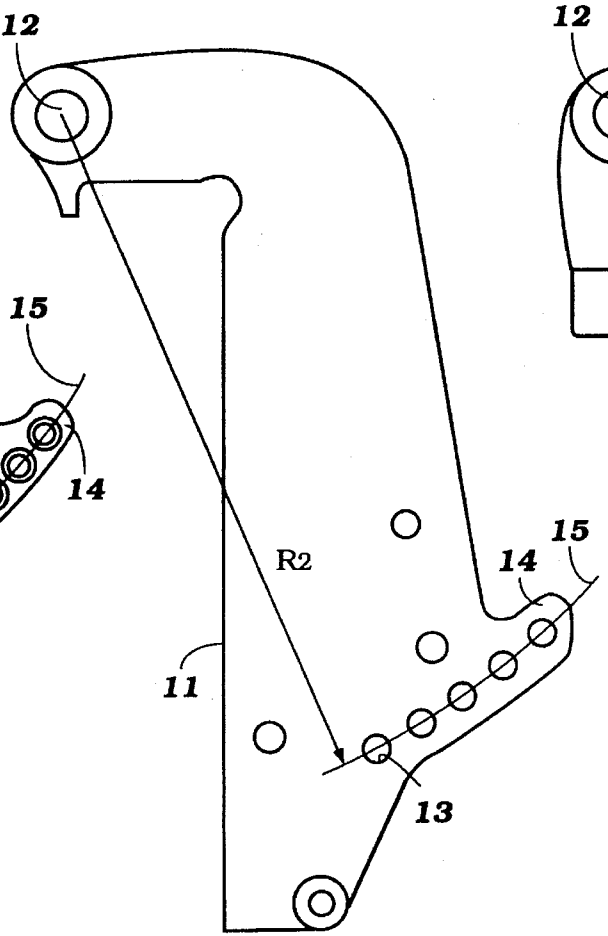
Figure 2 Prior Art
Figure 1:
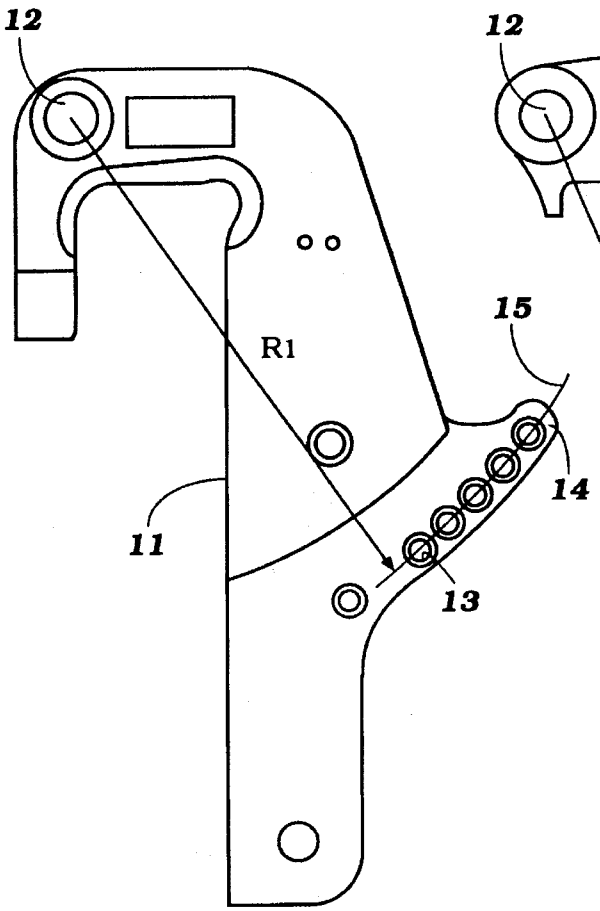
Figure 1 Prior Art
Figure 5:
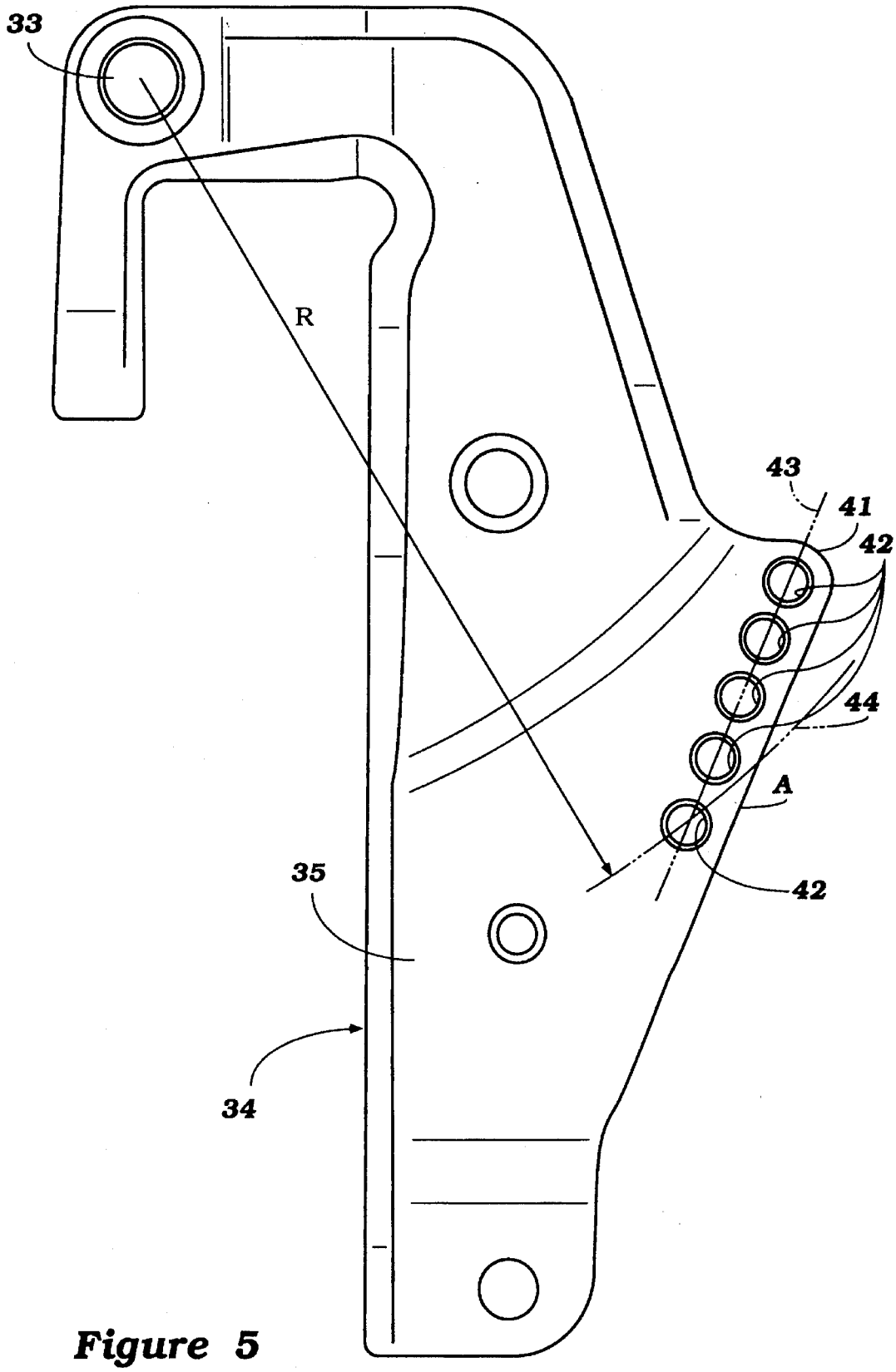
FIG. 5 is a side elevational view, in part similar to FIGS. 1–3, and shows the clamping bracket in accordance with this embodiment of the invention.
Figure 8:
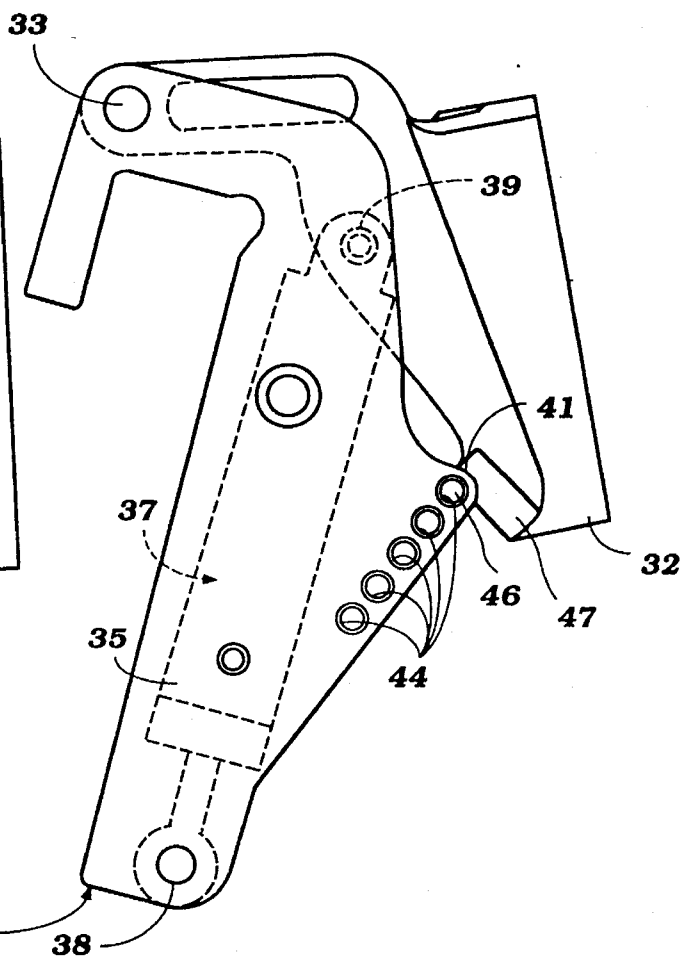
FIGS. 6, 7, and 8 are side elevational views of only the clamping bracket and swivel bracket of the preferred embodiment, showing three different trim-adjusted positions to illustrate how the wear on the swivel bracket is balanced.
Figure 7:
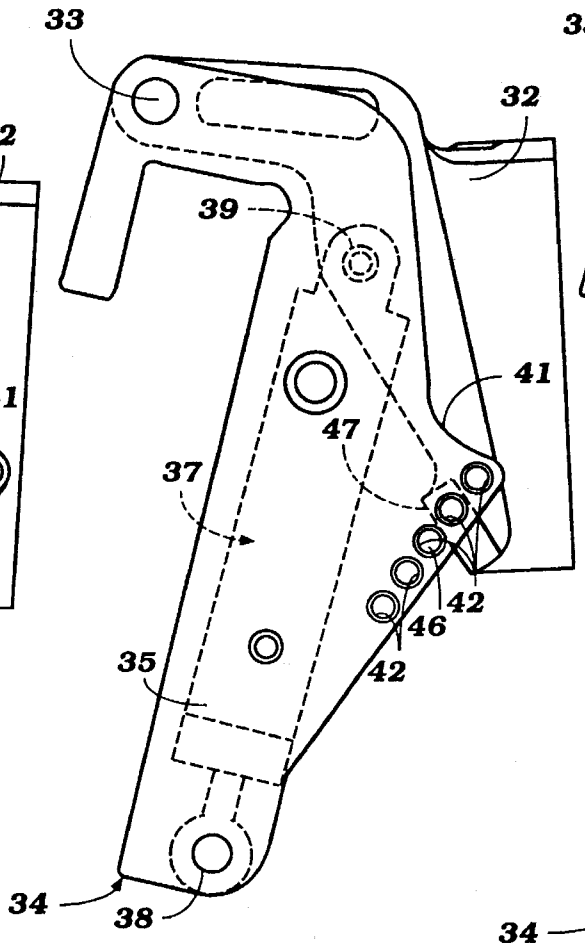
Figure 6:
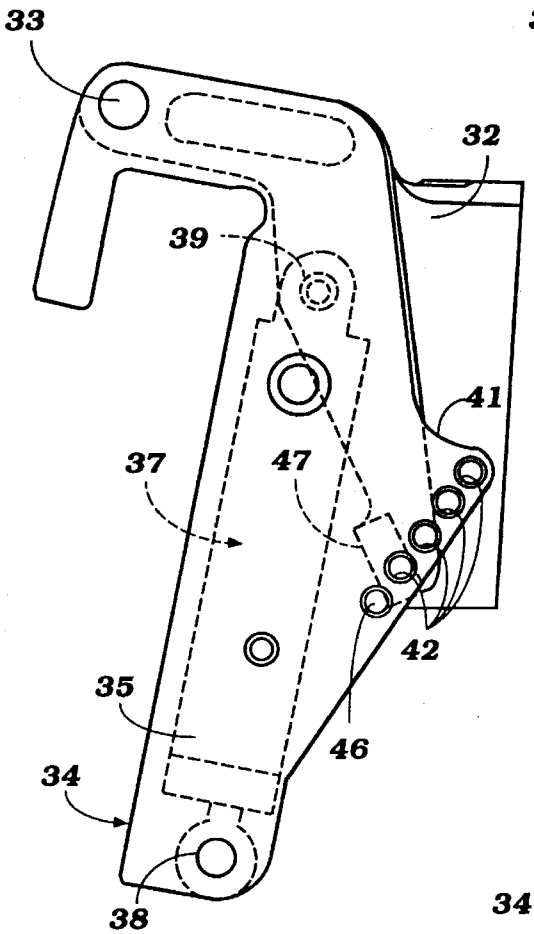

In this portion 41 there are provided a plurality of trim adjustment apertures 42 in each of the side bracket portions 35 which are aligned with each other. However, unlike the prior art type of constructions, these apertures 42 have their centers lying within a plane 43 which is disposed at an acute angle to the steering axis defined by the swivel bracket 32 and also to the transom of the watercraft to which the clamping bracket 34 is affixed. In FIG. 5 there is shown an arc, indicated in phantom and identified by the reference numeral 44, which has a radius R and which is drawn around the center of the trim pivot pin 33 to show how the line 43 is displaced well forward of the prior art type of constructions as shown in FIGS. 1–3.

Figure 9:
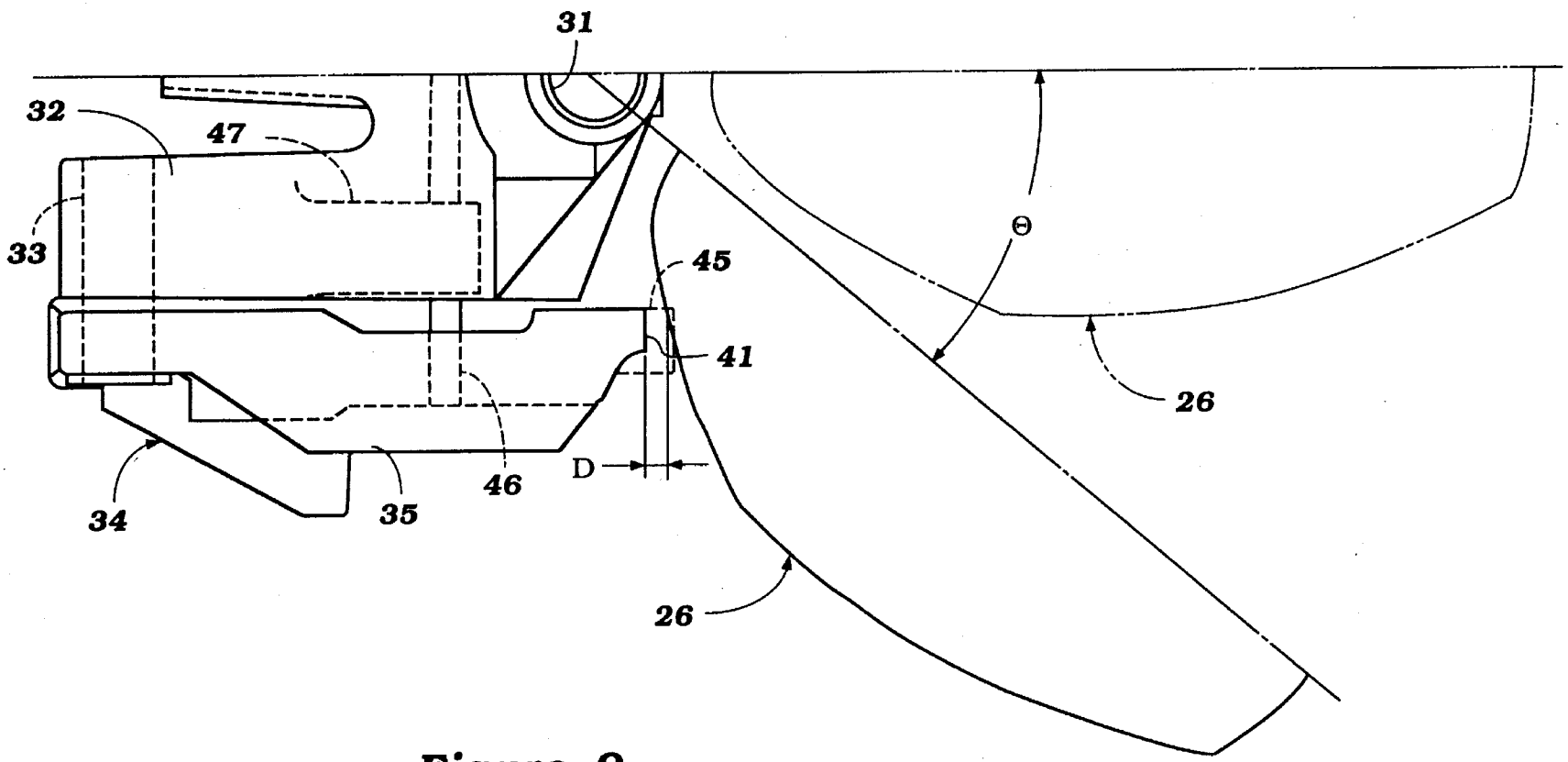
FIG. 9 is a partial top plan view of the embodiment of the invention, showing how the construction permits a greater latitude of steering movement than the prior art type of construction. The phantom line view shows the propulsion device in its straight-ahead position and that in the solid line view shows it rotated through an angle θ of steering movement.

As a result of this, the extension 41 is well placed forwardly of the prior art type of constructions. The net effect of this on the steering of the outboard motor may be seen in FIG. 9, wherein the broken line 45 shows where the prior art type of constructions would terminate at a distance D from the present construction. As a result, it is clearly evident that the amount in which the outboard motor may be steered is significantly increased with this type of arrangement without adversely affecting the amount of trim adjustment that is possible.

Continuing to refer primarily to FIGS. 5–9, a trim-adjusting pin 46 is positioned in a selective pair of the apertures 44 and is disposed so as to be engaged with a surface portion 47 of the swivel bracket 32 so as to set the trim-adjusted position. As may be seen from FIGS. 6 and 7, which show the fully trimmed-down, intermediate, and fully trimmed-up positions, the point where the trim pin 46 engages the surface 47 will depend upon the angular position. Said another way, the trim pin 46 does not always engage the same area of the surface 47 regardless of the trim-adjusted positions as is true with the prior art type of constructions. Hence, the wear on the surface 47 will be spread fairly equally, and no one section will be subject to high wear that could change the trim-adjusted position during use.

It should be readily apparent from the foregoing description that the described construction provides a very effective trim-adjustment mechanism and permits at the same time a compact assembly and one wherein the wear on the swivel bracket is made more uniform. Of course, the foregoing description is that of a preferred embodiment of the invention, and various changes and modifications may be made without departing from the spirit and scope of the invention as defined by the appended claims.

I claim:

1. An outboard motor comprised of a clamp bracket adapted to be affixed to a transom of an associated watercraft, a swivel bracket connected to said clamp bracket for pivotal movement about a trim axis, said swivel bracket carrying a propulsion device for propelling the associated watercraft, a hydraulic cylinder interposed between said clamp bracket and said swivel bracket for controlling the pivotal movement of said swivel bracket about said trim axis, said hydraulic cylinder having a first portion having a first pivotal connection to said swivel bracket and a second portion having a pivotal connection to a lower part of said clamp bracket, said clamp bracket being formed with a series of apertures for receiving a trim pin operably engaged with said swivel bracket for adjusting the trim of said propulsion device, said apertures being arranged vertically along an upwardly inclined line and spaced rearwardly from the transom from a line passing through said first and said second pivotal connections of said hydraulic cylinder, all but the lowermost of said apertures being positioned forwardly of an arc drawn about said trim axis and of a radius passing through said lowermost of said apertures, said apertures being disposed so that a trim pin received therein will engage a different portion of a continuous surface of said swivel bracket depending upon which apertures the trim pin is positioned in.

2. An outboard motor as in claim 1, wherein the apertures are arranged in a row so that their centers all lie in a common plane that is disposed at an acute angle to the transom of the associated watercraft.

3. An outboard motor as in claim 1, wherein the clamp bracket comprises a pair of spaced-apart side members each having apertures aligned with each other for receiving opposite ends of the trim pin.

4. An outboard motor as in claim 3, wherein the apertures are arranged in a row so that their centers all lie in a common plane that is disposed at an acute angle to the transom of the associated watercraft.

5. An outboard motor as in claim 1, wherein the apertures are disposed so that a trim pin engaged in each aperture will engage the swivel bracket at a different location.

6. An outboard motor as set forth in claim 2, wherein the apertures are also disposed at an acute angle to the line passing through the first and second pivotal connections of the hydraulic cylinder.

7. An outboard motor as set forth in claim 4, wherein the apertures are also disposed at an acute angle to the line passing through the first and second pivotal connections of the hydraulic cylinder.

8. An outboard motor comprised of a clamp bracket adapted to be affixed to a transom of an associated watercraft, a swivel bracket connected to said clamp bracket for pivotal movement about a trim axis, said swivel bracket carrying a propulsion device for propelling the associated watercraft, a hydraulic cylinder interposed between said clamp bracket and said swivel bracket for controlling the pivotal movement of said swivel bracket about said trim axis, said hydraulic cylinder having a first portion having a first pivotal connection to said swivel bracket and a second portion having a pivotal connection to said clamp bracket, said clamp bracket being formed with a series of apertures for receiving a trim pin operably engaged by said swivel bracket for adjusting the trim of said propulsion device, said apertures being disposed so that a trim pin received therein will engage the swivel bracket at a different position from the others and spaced rearwardly from the transom from a line passing through said first and said second pivotal connections of said hydraulic cylinder.

9. An outboard motor as in claim 8, wherein the clamp bracket comprises a pair of spaced-apart side members each having apertures aligned with each other for receiving opposite ends of the trim pin.

10. An outboard motor as in claim 9, wherein the apertures are arranged in a row so that their centers all lie in a common plane that is disposed at an acute angle to the transom of the associated watercraft.

11. An outboard motor as set forth in claim 10, wherein the apertures are also disposed at an acute angle to the line passing through the first and second pivotal connections of the hydraulic cylinder.

* * * * *